US009805711B2

(12) United States Patent
Tanaka

(10) Patent No.: US 9,805,711 B2
(45) Date of Patent: Oct. 31, 2017

(54) SOUND SYNTHESIS DEVICE, SOUND SYNTHESIS METHOD AND STORAGE MEDIUM

(71) Applicant: CASIO COMPUTER CO., LTD., Tokyo (JP)

(72) Inventor: Hyuta Tanaka, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/969,150

(22) Filed: Dec. 15, 2015

(65) Prior Publication Data

US 2016/0180833 A1 Jun. 23, 2016

(30) Foreign Application Priority Data

Dec. 22, 2014 (JP) ..... 2014-259485

(51) Int. Cl.
*G10L 13/10* (2013.01)
*G10L 13/033* (2013.01)

(52) U.S. Cl.
CPC ..... *G10L 13/10* (2013.01); *G10L 13/0335* (2013.01)

(58) Field of Classification Search
USPC ..... 704/258–269
See application file for complete search history.

(56) References Cited

U.S. PATENT DOCUMENTS 4,692,941 A * 9/1987 Jacks ..... G10L 13/04 704/260
5,636,325 A * 6/1997 Farrett ..... G10L 13/10 704/231
5,642,466 A * 6/1997 Narayan ..... G10L 13/10 704/200
5,796,916 A * 8/1998 Meredith ..... G10L 13/10 704/207
5,832,434 A * 11/1998 Meredith ..... G10L 13/10 704/258

(Continued)

OTHER PUBLICATIONS

Cambell et al., "Chatr: a multi-lingual speech re-sequencing synthesis system," Technical Report of The Institute of Electronics, Information and Communication Engineers, SP96-7 (May 1996). (English abstract included as a concise explanation of relevance.).

(Continued)

*Primary Examiner* — Abul Azad
(74) *Attorney, Agent, or Firm* — Chen Yoshimura LLP

(57) ABSTRACT

A sound synthesis device that includes a processor configured to perform the following: extracting intonation information from prosodic information contained in sound data and digitally smoothing the extracted intonation information to obtain smoothed intonation information; obtaining a plurality of digital sound units based on text data and concatenating the plurality of digital sound units so as to construct a concatenated series of digital sound units that corresponds to the text data; and modifying the concatenated series of digital sound units in accordance with the smoothed intonation information with respect to at least one of parameters of the concatenated series of digital sound units to generate synthesized sound data corresponding to the text data.

10 Claims, 8 Drawing Sheets

(56) References Cited

U.S. PATENT DOCUMENTS

| | | | | |
|---|---|---|---|---|
| 5,940,797 | A * | 8/1999 | Abe | G10L 13/10 704/258 |
| 6,625,575 | B2 * | 9/2003 | Chihara | G10L 13/10 704/260 |
| 2007/0271099 | A1 * | 11/2007 | Kagoshima | G10L 13/047 704/258 |
| 2009/0055158 | A1 * | 2/2009 | Xu | G06F 17/289 704/2 |
| 2014/0236585 | A1 * | 8/2014 | Subasingha | G10L 25/90 704/207 |

OTHER PUBLICATIONS

Kawai et al., "Ximera: A Concatenative Speech Synthesis System with Large Scale Corpora," The Journal of The Institute of Electronics, Information and Communication Engineers, D vol. J89-D No. 12 pp. 2688-2698, 2006.

Hisashi Kawai, "Corpus-Based Speech Synthesis," [online], ver.1/2011.1.7, The Institute of Electronics, Information and Telecommunication Engineers, [search conducted on Dec. 5, 2014], internet: <URL: http://27.34.144.197/files/02/02gun_07hen_03.pdf#page=6>.

Yoshinori Sagisaka, "Prosody Generation," [online], ver.1/2011.1.7, TheInstitute of Electronics, Information and Communication Engineers, [search conducted on Dec. 5, 2014], internet: <URL: http://27.34.144.197/files/02/02gun_07hen_03.pdf#page=13>.

Adachi et al., "Interactive Speech Conversion System Tracing Speaker Intonation Automatically", p. 1-8 (English abstract included as a concise explanation of relevance.).

* cited by examiner

Speech Data

Phoneme Label

Acoustic Data

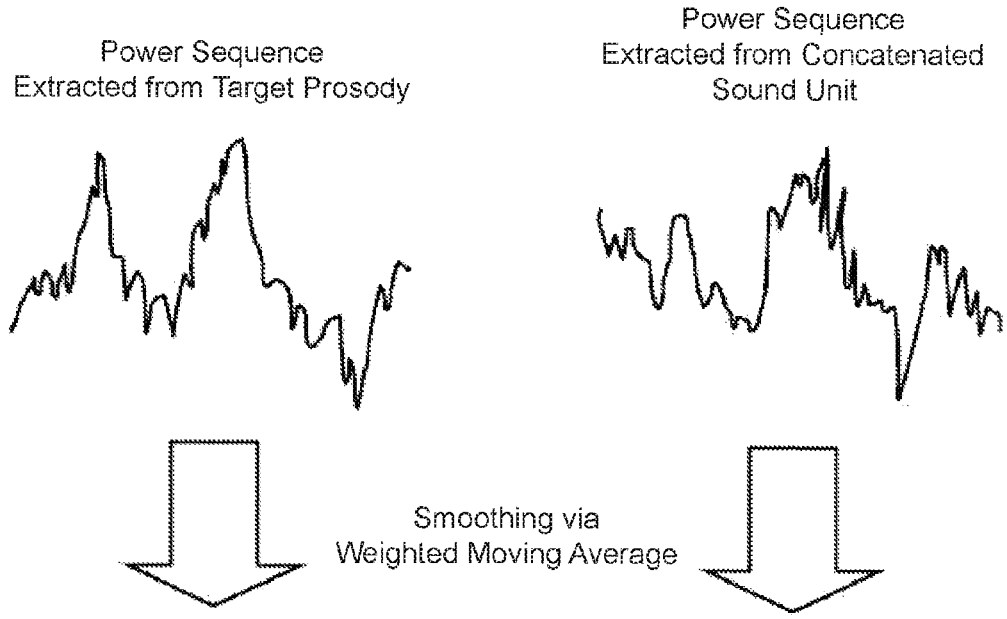
FIG. 6A-1
FIG. 6A-2
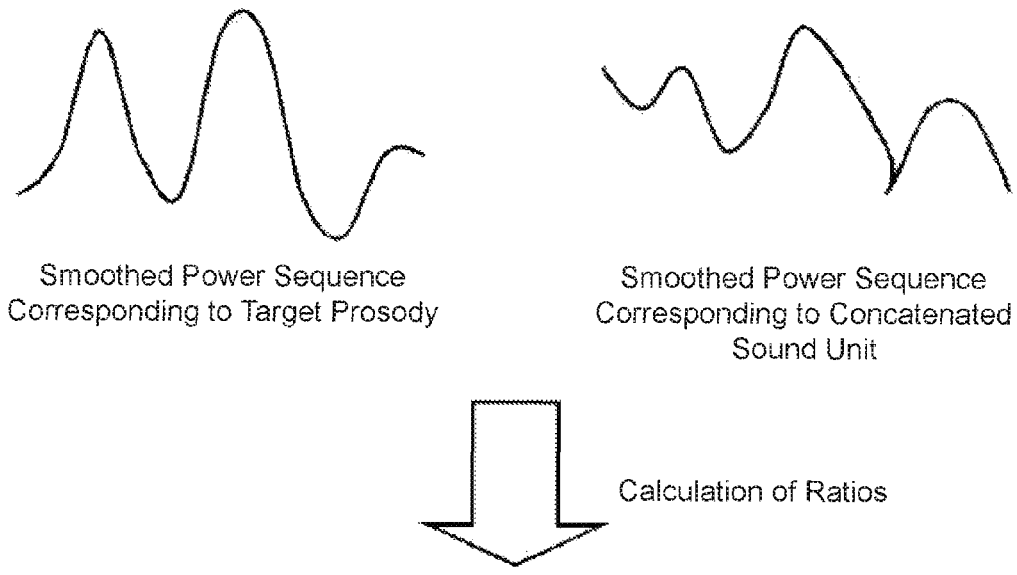
FIG. 6B-1
FIG. 6B-2

SOUND SYNTHESIS DEVICE, SOUND SYNTHESIS METHOD AND STORAGE MEDIUM

BACKGROUND OF THE INVENTION

Technical Field

The present invention relates to a sound synthesis device, a sound synthesis method and a storage medium.

Speech synthesis is a well-known form of technology. With respect to a target specification generated from input text data, speech synthesis technology selects speech waveform segments (hereafter referred to as "sound units," which include sub-phonetic segments, phonemes, and the like) by referring to a speech corpus, which contains a large amount of digitized language and speech data, and then produces synthesized speech by concatenating these sound units. (For example, [a] "Chatr: a multi-lingual speech re-sequencing synthesis system," Technical Report of The Institute of Electronics, Information and Communication Engineers, SP96-7.

[b] "Ximera: A Concatenative Speech Synthesis System with Large Scale Corpora," The Journal of The Institute of Electronics, Information and Communication Engineers, D Vol. J89-D No. 12 pp. 2688-2698.

[c] Hisashi Kawai, "Corpus-Based Speech Synthesis," [online], ver. 1/2011.1.7, The Institute of Electronics, Information and Telecommunication Engineers, [search conducted on Dec. 5, 2014], internet: <URL: http://27.34.144.197/files/02/02gun_07hen_03.pdf#page=6>)

Within this type of speech synthesis technology, the technology described in Non-Patent Document 3, for example, is conventionally well-known as a method for selecting a sequence of sound units from the speech corpus that is the best match for the target specification. This technology will be described next. First, sound unit data (hereafter referred to as "phoneme data"), which has the same phoneme sequences as phoneme sequences extracted from the input text data, is extracted from the speech corpus as phoneme candidate data for each of the extracted phoneme sequences. Next, the optimal combination of phoneme candidate data (the optimal phoneme data sequence) that has the lowest cost for all of the input text data is determined using a DP (dynamic programming) algorithm. Various parameters can be used to represent the cost, such as differences in the phoneme sequences and prosody between the input text data and the phoneme data within the speech corpus, and discontinuities and the like in the acoustic parameters (especially the feature vector data) of the spectral envelope and the like between adjacent pieces of phoneme data that make up the phoneme candidate data.

Phoneme sequences corresponding to the input text data are obtained by carrying out morphological analysis on the input text data, for example.

The prosody of the input text data (hereafter referred to as "the target prosody") is the strength (power), duration, and height of the pitch, which is the fundamental frequency of the vocal cord, for each of the phonemes. One method for determining the target prosody is to use a statistical model, based on actual speech data, on the linguistic information obtained from the input text data (Yoshinori Sagisaka, "Prosody Generation," [online], ver. 1/2011.1.7, The Institute of Electronics, Information and Communication Engineers, [search conducted on Dec. 5, 2014], internet <URL: http://27.34.144.197/files/02/02gun_07hen_03.pdf#page=13>, for example). Linguistic information is obtained by performing morphological analysis on the input text data, for example. Alternatively, another method for determining the target prosody is to have a user input parameters using numerical values.

A third method for determining the target prosody is to use speech input that is provided, such as input of a user reading the input text data out loud, for example. Compared to adjusting numerical value parameters and making approximations from text, this method allows for more intuitive operation, and also has the benefit of allowing for the target prosody to be determined with a high degree of freedom, such as being able to add feeling and intonation to the words.

There are problems with using speech input by a user to determine the target prosody, however. These problems will be explained next. The first problem is that because the degree of freedom for the target prosody increases, it is necessary to have all of the sound units that correspond to that prosody; thus, the speech corpus database becomes extremely large when an individual tries to store an adequate number of sound units to make identification possible. In addition, it may be difficult to choose an appropriate sound unit since the target prosody of the speech input by the user and the prosody of the sound units in the speech database may differ depending on the characteristics, such as voice pitch, of the individual, for example.

One well-known method used to resolve the above-mentioned problems involves using signal processing during concatenation to correct the sound unit elements listed below, thereby adapting the sound unit to the target prosody of the speech input by the user.

1. Duration of the respective phonemes
2. Pitch (how high or low the sound is)
3. Power (magnitude of the sound)

When the target prosody of speech input by the user is simply adapted to a sound unit from the speech database via signal processing and no other steps are involved, however, the following problems occur. Minute changes in pitch and power are included in the target prosody of the speech input by the user, and when these are all adapted to the sound unit, there is a pronounced degradation in sound quality due to signal processing. In addition, when there is a significant difference between the prosody (especially the pitch) of the sound unit and the target prosody of the speech input by the user, the sound quality of the synthesized speech degrades when the target prosody is simply adapted to the sound unit.

SUMMARY OF THE INVENTION

Accordingly, the present invention is directed to a sound synthesis device and method that substantially obviate one or more of the problems due to limitations and disadvantages of the related art.

An object of the present invention is to provide a sound synthesis device and method that improve sound quality of synthesized speech while maintaining a high degree of freedom by making it unnecessary to have a large speech corpus when determining a target prosody via speech input.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides a sound synthesis device, including a processor configured to perform the following: extracting intonation information from prosodic information contained in sound data and digitally smoothing the extracted intonation information to obtain smoothed intonation information; obtaining a plurality of digital sound units based on text data and concatenating the plurality of digital sound units so as to construct a concatenated series of digital sound units that corresponds to the text data; and modifying the concatenated series of digital sound units in accordance with the smoothed intonation information with respect to at least one of parameters of the concatenated series of digital sound units to generate synthesized sound data corresponding to the text data.

In another aspect, the present disclosure provides a method of synthesizing sound performed by a processor in a sound synthesis device, the method including: extracting intonation information from prosodic information contained in sound data and digitally smoothing the extracted intonation information to obtain smoothed intonation information; obtaining a plurality of digital sound units based on text data and concatenating the plurality of digital sound units so as to construct a concatenated series of digital sound units that corresponds to the text data; and modifying the concatenated series of digital sound units in accordance with the smoothed intonation information with respect to at least one of parameters of the concatenated series of digital sound units to generate synthesized sound data corresponding to the text data.

In another aspect, the present disclosure provides a non-transitory storage medium that stores instructions executable by a processor included in a sound synthesis device, the instructions causing the processor to perform the following: extracting intonation information from prosodic information contained in sound data and digitally smoothing the extracted intonation information to obtain smoothed intonation information; obtaining a plurality of digital sound units based on text data and concatenating the plurality of digital sound units so as to construct a concatenated series of digital sound units that corresponds to the text data; and modifying the concatenated series of digital sound units in accordance with the smoothed intonation information with respect to at least one of parameters of the concatenated series of digital sound units to generate synthesized sound data corresponding to the text data.

It is to be understood that both the foregoing general description and the following detailed description are exemplary and explanatory, and are intended to provide further explanation of the invention as claimed.

BRIEF DESCRIPTION OF THE DRAWINGS

FIGS. 6A-1 to 6B-2 illustrate power adaptation processing.

DETAILED DESCRIPTION OF EMBODIMENTS

Figure 1:
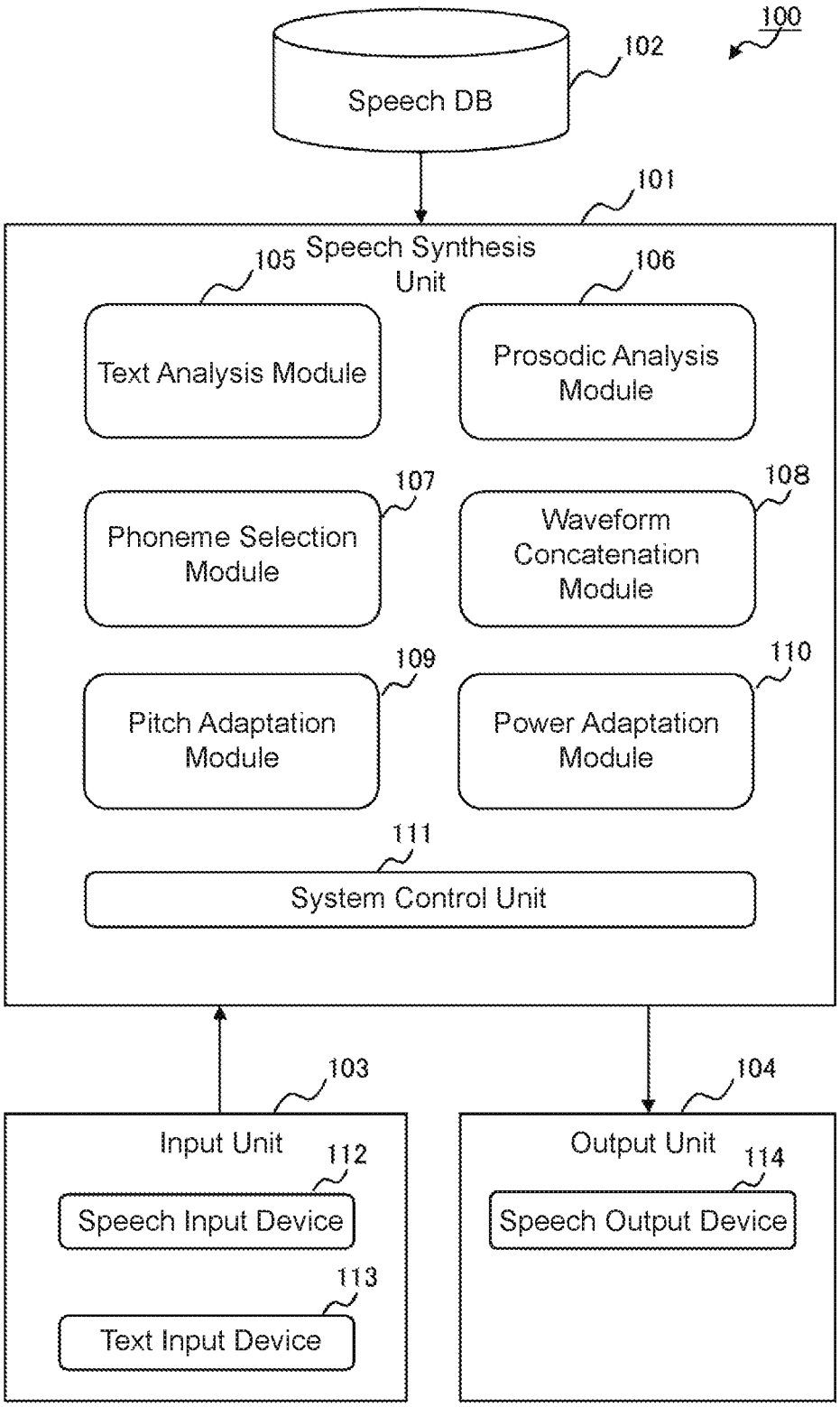
FIG. 1 is a block diagram of an embodiment of a speech synthesis device.

An embodiment of the present invention is described below with reference to drawings. FIG. 1 is a block diagram of an embodiment of a speech synthesis device 100. The speech synthesis device includes: a speech synthesis unit 101; a speech database (hereafter referred to as speech DB) 102; an input unit 103; and an output unit 104. The speech synthesis unit 101 includes: a text analysis module 105; a prosodic analysis module 106; a phoneme selection module 107; a waveform concatenation module 108; a pitch adaptation module 109; a power adaptation module 110; and a system control unit 111. The input unit 103 includes a speech input device 112 and a text input device 113. The output unit 104 includes a speech output device 114. The phoneme selection module 107 and the waveform concatenation module 108 correspond to a sound unit selection/concatenation unit, and the pitch adaptation module 109 and the power adaptation module 110 correspond to an intonation information extraction unit and an intonation adaptation unit.

Input text data is input via the text input device 113 of the input unit 103. Input speech data is input via the speech input device 112 of the input unit 103.

The speech synthesis unit 101, with respect to a target specification generated from input text data input via the text input device 113, selects sound units by referring to a speech corpus, which is a collection of sound units stored in the speech DB 102, and generates a concatenated sound unit by concatenating the sound units.

Figures 2A, 2B, 2C:
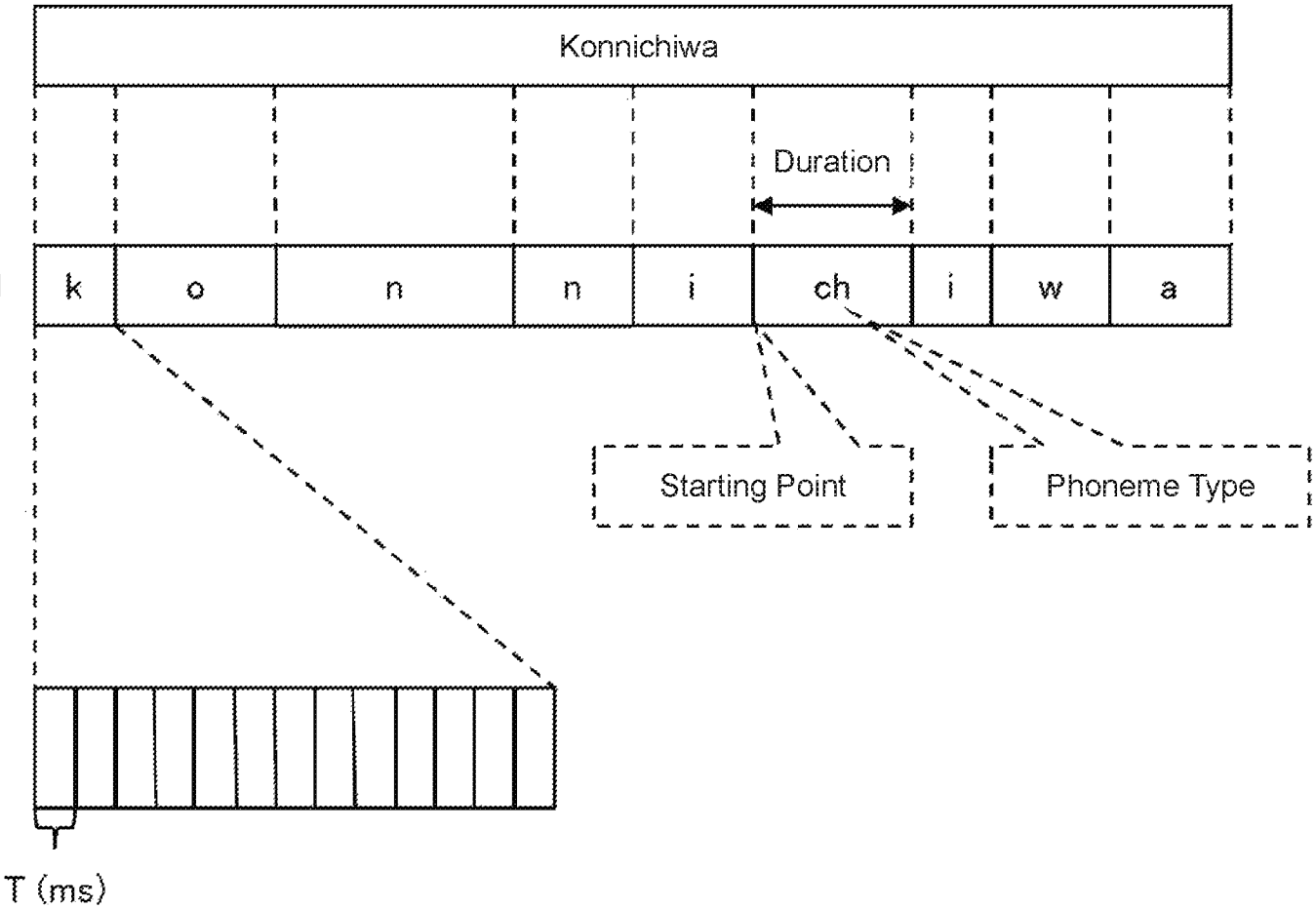
FIGS. 2A to 2C show an example configuration of speech DB data.

FIGS. 2A to 2C show an example configuration of speech corpus data stored in the speech DB 102 of FIG. 1. The following are examples of types of data that can be stored as part of the speech corpus:

Pre-recorded speech data (FIG. 2A)

Phoneme label information for the speech data in FIG. 2A (FIG. 2B). These labeled fragments of speech data in FIG. 2A are essentially sound units. As shown in FIG. 2B, this phoneme label information includes various types of information, such as "starting point," "duration," and "phoneme type."

Acoustic information, such as pitch, power, and formant, that has been obtained from the speech data of FIG. 2A for each segment of a prescribed period of time T (in milliseconds (ms)) (FIG. 2C). The segment length T may be 10 ms, for example.

Returning to the description of FIG. 1, the text analysis module 105 within the speech synthesis unit 101 extracts accented phoneme sequences that correspond to the input text data by performing morphological analysis, for example, on the input text data received by the text input device 113.

The prosodic analysis module 106 within the speech synthesis unit 101 extracts a target prosody by analyzing the input speech data received by the speech input device 112.

The phoneme selection module (sound unit selection/concatenation unit) 107 within the speech synthesis unit 101, by referring to the speech corpus (FIGS. 2A to 2C) within the speech data, selects sound units that correspond to the target specification made up of the phoneme sequence generated from the input text data and the target prosody generated from the input speech data.

The waveform concatenation module 108 within the speech synthesis unit 101 generates a concatenated sound unit by concatenating the sound units selected by the phoneme selection module 107.

The pitch adaptation module 109 within the speech synthesis unit 101 modifies a pitch sequence included in the concatenated sound unit output by the waveform concatenation module 108 so that the pitch sequence is adapted to a pitch sequence included in the input speech data input via the speech input device 112 of the input unit 103.

The power adaptation module 110 within the speech synthesis unit 101 modifies a power sequence included in the concatenated sound unit output by the waveform concatenation module 108 so that the power sequence is adapted to a power sequence included in the input speech data input via the speech input device 112 in the input unit 103.

The system control unit 111 within the speech synthesis unit 101 controls the order of operation and the like of the various components 105 to 110 within the speech synthesis unit 101.

Figure 3:
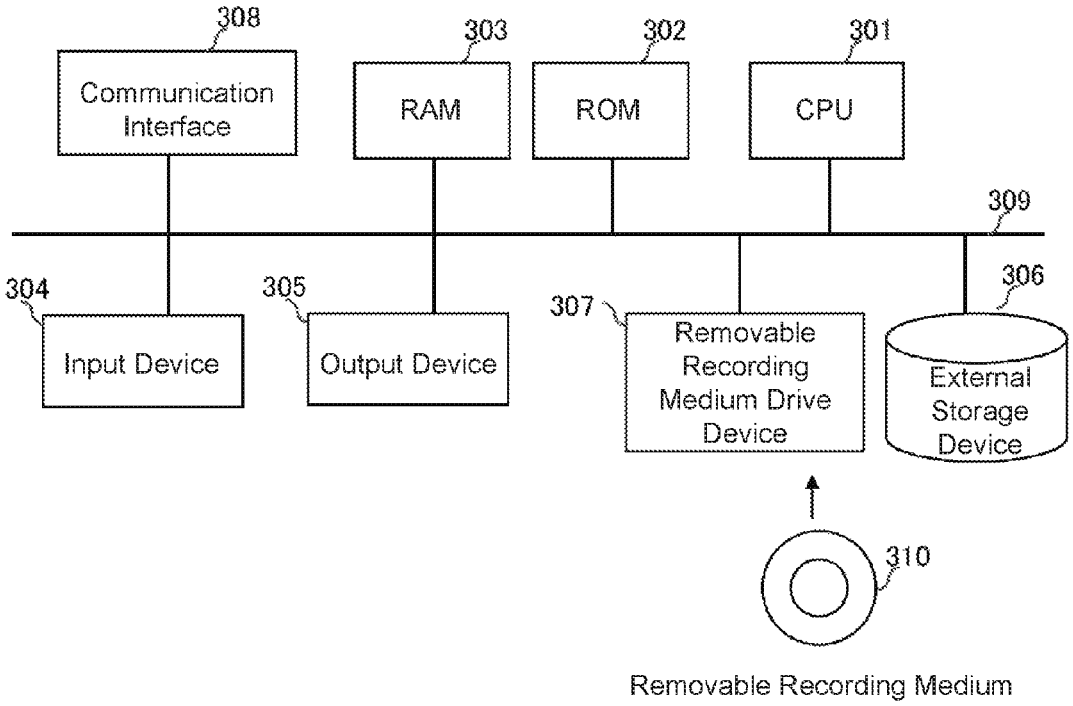
FIG. 3 shows an example hardware configuration of an embodiment of a speech synthesis device.

FIG. 3 shows an example hardware configuration of a computer in which the speech synthesis device 100 of FIG. 1 can be realized as software processing. The computer shown in FIG. 3 includes: a CPU 301; ROM (read-only memory) 302; RAM (random access memory) 303; an input device 304; an output device 305; an external storage device 306; a removable recording medium drive device 307 in which a removable recording medium 310 is inserted; and a communication interface 308. The computer is configured such that all of these components are interconnected via a bus 309. The configuration shown in FIG. 3 is one example of a computer in which the above-mentioned system can be realized. Such a computer is not limited to the configuration described above.

The ROM 302 is memory that stores various programs, including speech synthesis programs, for controlling the computer. The RAM 303 is memory in which programs and data stored in the ROM 302 are temporarily stored when the various programs are executed.

The external storage device 306 is a SSD (solid-state drive) memory device or a hard-disk memory device, for example, and can be used to save input text data, input speech data, concatenated sound unit data, synthesized speech data, or the like. In addition, the external storage device 306 stores the speech DB 102 contained within the speech corpus that has the data configuration shown in FIGS. 2A to 2C.

The CPU 301 controls the entire computer by reading various programs from the ROM 302 to the RAM 303 and then executing the programs.

The input device 304 detects an input operation performed by a user via a keyboard, a mouse, or the like, and notifies the CPU 301 of the detection result. Furthermore, the input device 304 includes the function of the speech input device 112 in the input unit 103 shown in FIG. 1. Input speech data is input into the input device 304 via a microphone or a line input terminal (not shown), converted into digital data via an A/D (analog-digital) converter, and then stored in the RAM 303 or the external storage device 306. Moreover, the input device 304 includes the function of the text input device 113 in the input unit 103 shown in FIG. 1. Input text data is input into the input device 304 via a keyboard, device interface, or the like (not shown), and then stored in the RAM 303 or the external storage device 306.

The output device 305 outputs data sent via the control of the CPU 301 to a display device or a printing device. The output device 305 converts the synthesized speech data output by the CPU 301 to the external storage device 306 or the RAM 303 into an analog synthesized speech signal via a D/A converter (not shown). The output device 305 then amplifies the signal via an amplifier and outputs the signal as synthesized speech via a speaker.

The removable recording medium drive device 307 houses the removable recording medium 310, which is an optical disk, SDRAM, CompactFlash, or the like; thus, the drive device 307 functions as an auxiliary to the external storage device 306.

The communication interface 308 is a device for connecting LAN (local area network) or WAN (wide area network) telecommunication lines, for example.

In the speech synthesis device 100 according to the present embodiment, the CPU 301 realizes the functions of the various blocks 105 to 111 within the speech synthesis unit 101 shown in FIG. 1 by using the RAM 303 as a working memory and executing the speech synthesis programs stored in the ROM 302. These programs may be stored in and distributed to the external storage device 306 and the removable recording medium 310, for example. Alternatively, these programs may be acquired from a network via the communication interface 308.

Figure 4:
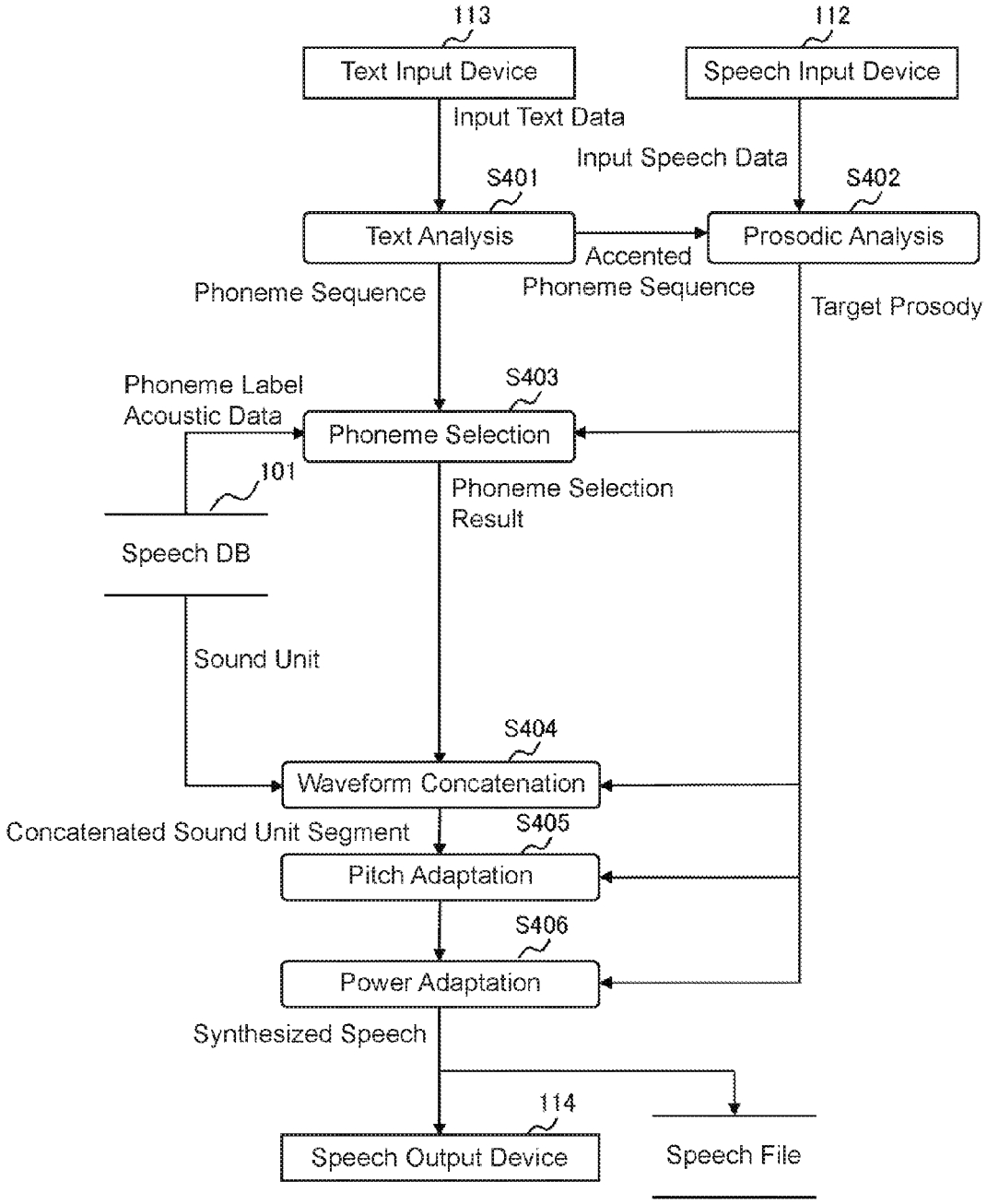
FIG. 4 is a flow chart that illustrates an example of speech synthesis processing.

FIG. 4 is a flow chart that shows an example of speech synthesis processing when the CPU 301 in a computer having the hardware configuration shown in FIG. 3 realizes, by executing software programs, the functions of the speech synthesis device 100 that corresponds to the configuration shown in FIG. 1. Hereafter, FIGS. 1, 2A to 2C, and 3 will be referred to as needed.

The CPU 301 first performs text analysis on the input text data input via the text input device 113 (Step S401). As part of this process, the CPU 301 extracts accented phoneme sequences corresponding to the input text data by performing morphological analysis, for example, on the input text data. This processing realizes the function of the text analysis module 105 shown in FIG. 1.

Next, the CPU 301 performs prosodic analysis on the input speech data input via the speech input device 112 (Step S402). As part of this process, the CPU 301 carries out pitch extraction and power analysis, for example, on the input speech data. The CPU 301 then calculates the pitch height (frequency), duration, and power (strength) for each of the phonemes by referring to the accented phoneme sequence obtained via the text analysis of Step S402, and then outputs this information as the target prosody.

Next, the CPU 301 executes phoneme selection processing (Step S403). As part of this process, the CPU 301 selects a phoneme sequence from the speech DB 102 in which the speech corpus having the data configuration shown in FIGS. 2A to 2C has been recorded. This phoneme sequence corresponds to the phoneme sequence computed in Step S401 and the target prosody computed in step S402. The phoneme sequence selection is performed such that the cost calculated for the phoneme and prosody is optimal. At this time, the CPU 301 first makes a list of phoneme candidate data from the speech corpus that satisfies phoneme evaluation cost conditions by comparing the phoneme label sequence (FIG. 2B) in the speech corpus with the phoneme sequence output in Step S401. Next, the CPU 301 selects, from the listed phoneme candidate data, the phoneme candidate data that best satisfies concatenation evaluation cost conditions by comparing the acoustic information (FIG. 2C) in the phoneme candidate data with the target prosody, and then ultimately selects a sequence of sound units.

Next, the CPU 301 executes waveform concatenation processing (Step S404). As part of this processing, the CPU 301 obtains the sound unit selection results from Step S403, and then outputs a concatenated sound unit by retrieving the corresponding sound unit speech data (FIG. 2A) from the speech corpus in the speech DB 102 and then connecting the sound units.

The concatenated sound unit that is output in the manner described above is selected from the speech corpus contained in the speech DB 102 such that the combined cost of the phoneme evaluation of the phonemes in the input phoneme sequence and the concatenation evaluation of the prosody of the target prosody is optimized. However, a small-scale system that cannot store a large database to use as a speech corpus is different in that the target prosody generated from the input speech data and the prosody of sound units in a limited-scale speech corpus may differ depending on the intonation and the like of the individual. Thus, when the concatenated sound unit is output in Step S404, the intonation expressed in the input speech data may not be sufficiently reflected in the concatenated sound unit. However, when the pitch and power of the concatenated sound unit are combined so as to try and simply match the pitch and power of the target prosody, slight changes in the pitch and power of the target prosody can affect the pitch and power of the concatenated sound unit, thus leading to a more noticeable decline in audio quality.

Thus, in the present embodiment, it is believed that broad changes in pitch and power within the target prosody will accurately reflect the intonation, or in other words, the emotions, of the speaker. Therefore, synthesized speech which accurately reflects the intonation information included in the target prosody is generated by extracting gradual changes in power and pitch from the target prosody and then shifting the pitch and power of the concatenated sound unit in accordance with the change data.

Figure 5A:
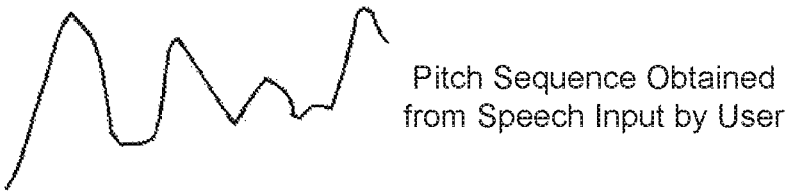
FIGS. 5A to 5C illustrate pitch adaptation processing.
Figure 5B:
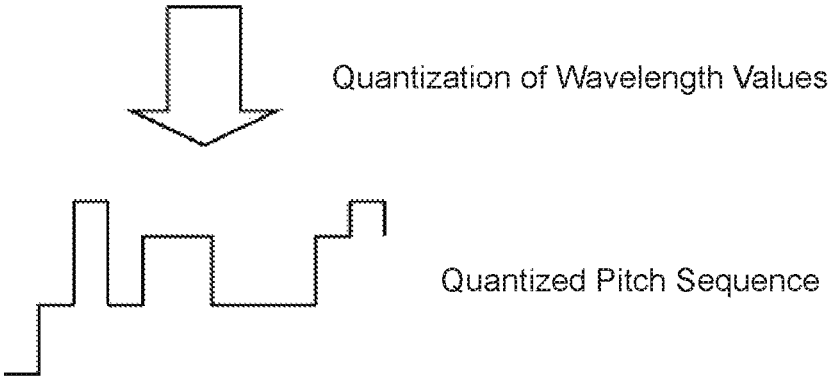
Figure 5C:
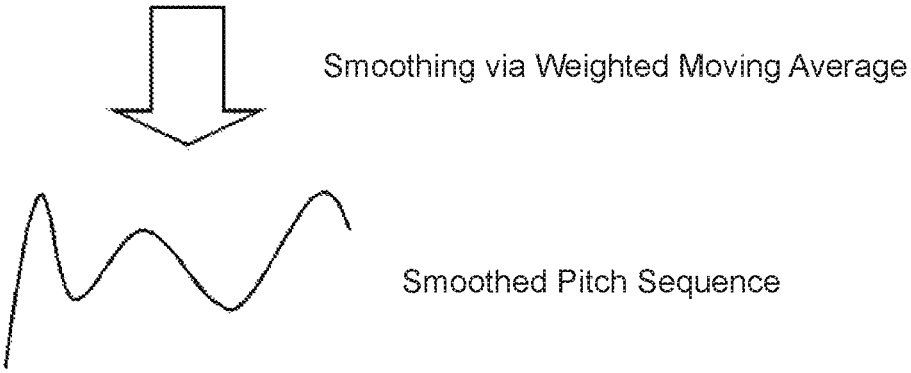

Thus, the CPU 301 executes pitch adaptation processing after carrying out the waveform concatenation processing of Step S404 (Step 405). FIGS. 5A to 5C illustrate pitch adaptation processing. As shown in FIG. 5A, the CPU 301 first extracts changes over time in pitch frequency from the target prosody as a pitch sequence. Next, as shown in FIG. 5B, the CPU 301 quantizes the various frequency values of the pitch sequence with an appropriate roughness and calculates a quantized pitch sequence. As a result, minute changes in pitch in the target prosody are eliminated, and a general outline of changes in pitch is obtained. Furthermore, as shown in FIG. 5C, the CPU 301 smoothes the quantized pitch sequence in the time direction by acquiring the weighted moving average in the time direction and then outputs a smoothed pitch sequence. Specifically, for example, the CPU 301 moves the calculation central sample location one sample at a time starting from the head of the quantized pitch sequence, and calculates the average value for predetermined sample portions on both sides of the calculation central sample location by having the frequency value linearly decrease by a prescribed amount moving away from the calculation central sample location, for example. The CPU then outputs this average as the calculated value of the calculation central sample location. By so doing, a smoothed pitch sequence can be obtained that corresponds to the pitch sequence with minute changes shown in FIG. 5A, and that has natural changes in pitch such as those shown in FIG. 5C. The CPU 301 shifts the pitch at each point in time of the concatenated sound unit output in Step S404 so that the values correspond to the pitch at each point in time of the smoothed pitch sequence generated in the above-described manner, and then outputs the result.

Next, the CPU 301 executes power adaptation processing after the pitch adaptation processing of Step S405 is completed (Step S406). The pitch adaptation processing and the power adaptation processing may be executed in any order. In addition, only one of pitch adaptation processing and power adaptation processing may be executed. FIGS. 6A-1 to 6B-2 illustrate power adaptation processing. As shown in FIG. 6A-1, the CPU 301 first extracts a sequence of power values (hereafter referred to as a "power sequence") from the target prosody, and, as shown in FIG. 6A-2, extracts a power sequence in a similar manner from the concatenated sound unit (the results of the pitch shift in Step S405). Next, the CPU 301 smoothes the respective power sequences in the time direction by acquiring the weighted moving averages in the time direction of the power sequences in a manner similar to that used for the pitch sequences. The CPU 301 then outputs a smoothed power sequence shown in FIG. 6B-1 that corresponds to the target prosody and a smoothed power sequence shown in FIG. 6B-2 that corresponds to the concatenated sound unit. As a result, in the respective power sequences, minute changes are eliminated and a general outline of changes in power is obtained. Furthermore, the CPU 301 calculates for each point in time a ratio between the sample value at that point in time of the smoothed power sequence that corresponds to the target prosody and the sample value at that point in time of the smoothed power sequence FIG. 6B-2 that corresponds to the concatenated sound unit. The CPU 301 then multiplies the ratios respectively calculated for each point in time by the respective sample values of the concatenated sound unit (the result of the pitch shift in Step S405), and outputs the result as the final synthesized speech.

The CPU 301 saves the synthesized speech data output in such a manner as a speech file in the RAM 303 or the external storage device 306, for example, and outputs the data as synthesized speech via the speech output device 114 shown in FIG. 1.

Figure 7:
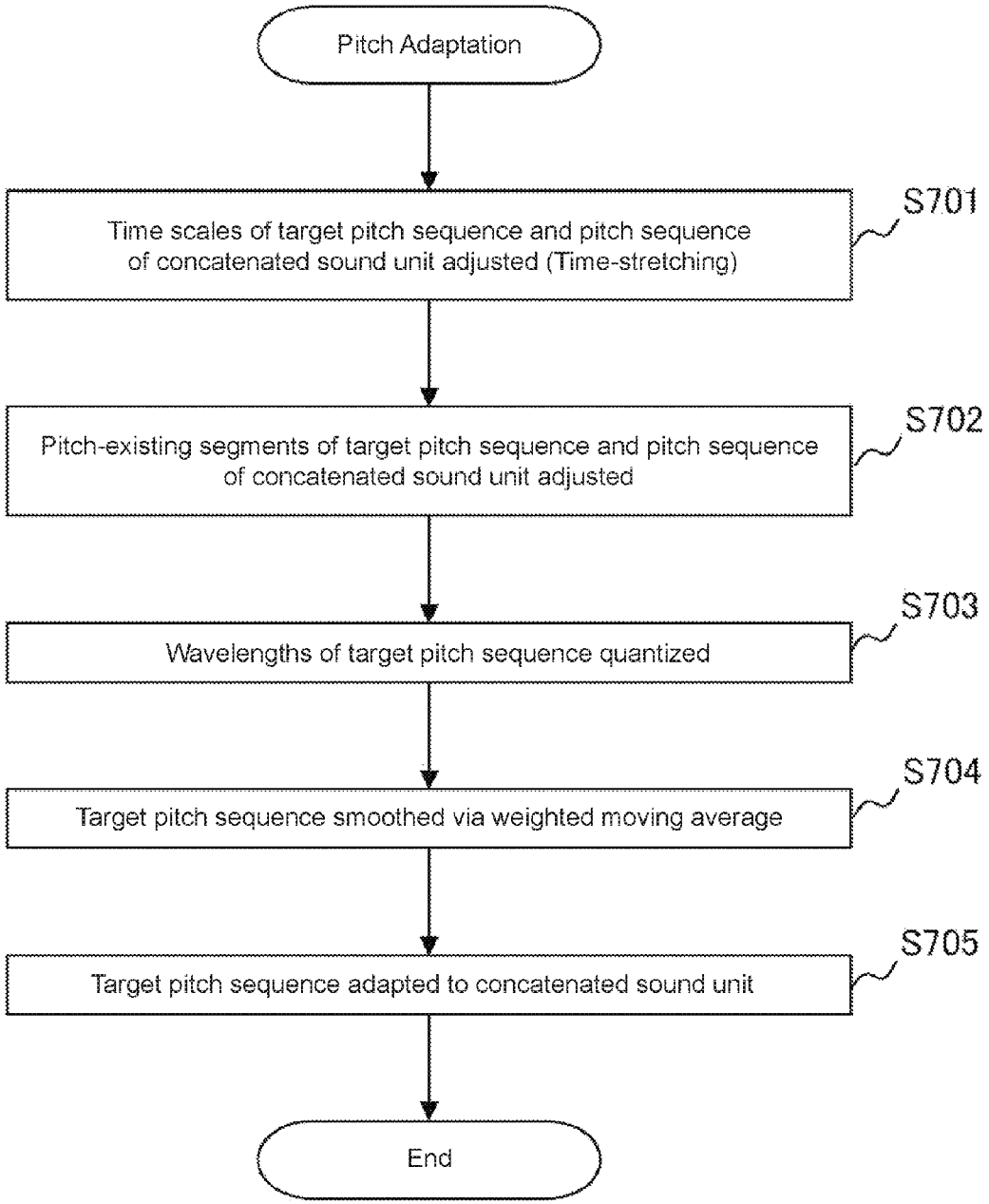
FIG. 7 is a flowchart showing pitch adaptation processing in detail.

FIG. 7 is a flow chart showing a detailed example of the pitch adaptation processing in Step S405 of FIG. 4.

The CPU 301 first extracts a pitch sequence (hereafter referred to as a "target pitch sequence") from the target prosody produced in Step S402 of FIG. 4, and then executes time-stretching that matches the time scale of the target pitch sequence to the time scale of the pitch sequence of the concatenated sound unit (Step S701). In this way, differences in the length of time between the two sequences are eliminated.

Next, the CPU 301 adjusts pitch-existing segments of the pitch sequence of the concatenated sound unit and the target pitch sequence on which time stretching was carried out in Step S701 (Step S702). Specifically, the CPU 301 compares the pitch sequence of the concatenated sound unit to the target pitch sequence, and then eliminates segments of the target pitch sequence that correspond to segments of the concatenated sound unit in which no pitch exists, for example.

Next, the CPU 301 quantizes (a process corresponding to the process shown in FIG. 5B) the frequency values of the target pitch sequence after the pitch-existing segments have been adjusted in Step S702 (Step S703). Specifically, the CPU 301 quantizes the target pitch sequence in units in which the pitch frequency is divided into "N" segments (more specifically, 3 to 10 segments or the like) per octave, for example.

Furthermore, the CPU 301 smoothes the target pitch sequence quantized in Step S703 by acquiring the weighted moving average as shown in FIG. 5C (Step S704).

Lastly, the CPU 301 adapts the smoothed target pitch sequence that was calculated in Step S704 to the concatenated sound unit (Step S705). Specifically, as shown in FIGS. 5A to 5C, the CPU 301 shifts the pitch at each point in time of the concatenated sound unit that was adjusted in Step S701 so as to correspond to the pitch at each point in time of the pitch sequence smoothed in Step S704, and then outputs the results.

Figure 8:
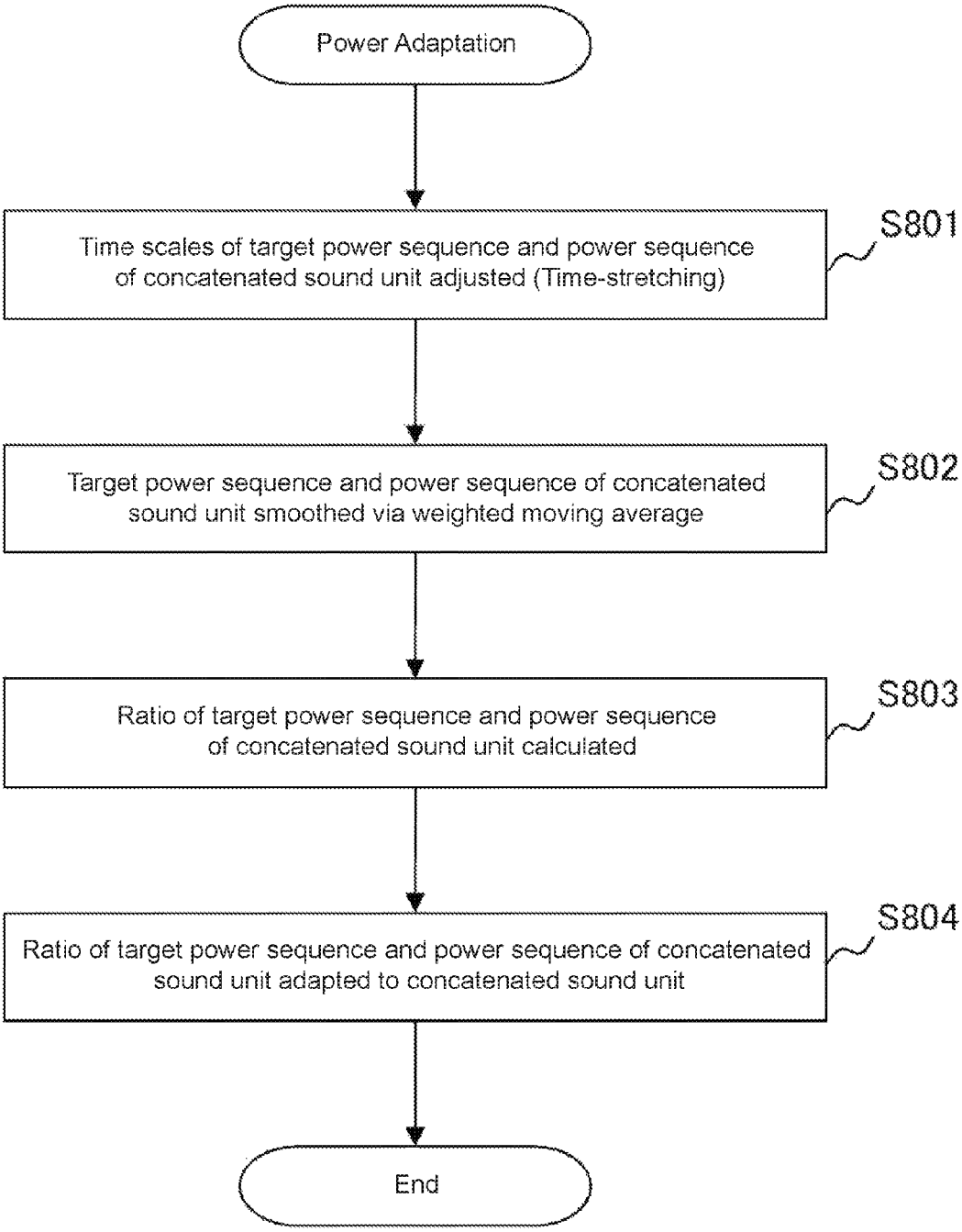
FIG. 8 is a flowchart showing power adaptation processing in detail.

FIG. 8 is a flow chart showing a detailed example of the power adaptation processing in Step S406 of FIG. 4.

The CPU 301 first extracts a power sequence (hereafter referred to as "the target power sequence") from the target prosody generated in Step S402 of FIG. 4. The CPU 301 then executes time stretching that matches the time scale of the target power sequence to the time scale of the power sequence of the concatenated sound unit (Step S801). The CPU 301 also adjusts the time scales so that the time scales match the results of the time stretching executed in Step S701 of FIG. 7.

Next, the CPU 301 smoothes the power sequence of the concatenated sound unit and the target power sequence on which time stretching was carried out in Step S801 via the calculation of the weighted moving averages as shown in FIGS. 6B-1 and 6B-2 (Step S802).

The CPU 301 then calculates a ratio at each point in time between the sample value at that point in time of the power sequence smoothed in Step S802, which corresponds to the calculated target prosody, and the sample value at that point in time of the smoothed power sequence that corresponds to the concatenated sound unit (Step S803).

Lastly, the CPU 301 adapts the values of the ratios respectively calculated at each point in time in Step S803 to the concatenated sound unit (Step S804). Specifically, as shown in FIGS. 6A-1 to 6B-2, the CPU 301 multiplies the values of the ratios respectively calculated at each point in time during Step S803 by the respective sample values of the concatenated sound unit and then outputs those results as the final synthesized speech.

In the embodiments described above, it was believed that large changes in pitch and power within the target prosody accurately reflect the intonation, or in other words the emotions, of the speaker. Thus, by extracting gradual changes in the pitch and power of the target prosody and shifting the pitch and power of the concatenated sound unit in accordance with this change data, synthesized speech is generated that accurately reflects the intonation information included in the target prosody. However, in the present embodiment, the intonation information is not limited to broad changes in pitch and power within the target prosody. For example, accent information that is extracted along with the phoneme sequence in Step S401 of FIG. 4 may be used as the intonation information, and adaptation processing may be executed in which a type of processing is carried out at the accent location of the concatenated sound unit output during the waveform concatenation processing of Step S404 of FIG. 4. Alternatively, if parameters that can realize the intonation information can be extracted from the input speech data, adaptation processing may be executed such that the concatenated sound unit is processed using the above-mentioned parameters.

As described above in the present embodiment, when a target prosody is determined via speech input in a waveform concatenation speech synthesis system, it is possible to maintain a high degree of freedom for intonation determination via speech input and avoid a large-scale increase in the size of the speech corpus while increasing the sound quality of the synthesized speech.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A sound synthesis device, comprising a processor configured to perform the following:

receiving text data and extracting phoneme sequence from the text data;

obtaining a plurality of digital sound units from a speech corpus database based on the text data and concatenating the plurality of digital sound units so as to construct a concatenated series of digital sound units that corresponds to the text data;

receiving oral input speech data and calculating, as a target prosody, at least one of pitch height, duration, and power parameters from the oral input speech data by referring to the phoneme sequence; and modifying the concatenated series of digital sound units in accordance with the target prosody to generate synthesized sound data corresponding to the input text data and the target prosody, wherein said processor smoothes a pitch sequence in the target prosody, and wherein, in smoothing said pitch sequence in the target prosody, said processor quantizes pitches of the pitch sequence, and smoothes the pitch sequence by acquiring a weighted moving average of the quantized pitches.

2. The sound synthesis device according to claim 1, wherein said processor concatenates the plurality of digital sound units to construct the concatenated series of digital sound units that meets a prescribed matching condition with respect to the text data.

3. The sound synthesis device according to claim 2, wherein the oral input speech data represents speech by a user.

4. The sound synthesis device according to claim 1, wherein said processor modifies a pitch sequence in the concatenated series of digital sound units so as to substantially match the the target prosody.

5. The sound synthesis device according to claim 4, wherein, in modifying the pitch sequence, said processor adjusts respective time scales of a pitch sequence in the target prosody and of said pitch sequence in the concatenated series of digital sound units, and adjusts at least one of the pitch sequence in the target prosody and the pitch sequence in the concatenated series of digital sound units so that periods during which pitches exist substantially match with each other.

6. A sound synthesis device, comprising a processor configured to perform the following:

receiving text data and extracting phoneme sequence from the text data;

obtaining a plurality of digital sound units from a speech corpus database based on the text data and concatenating the plurality of digital sound units so as to construct a concatenated series of digital sound units that corresponds to the text data;

receiving oral input speech data and calculating, as a target prosody, at least one of pitch height, duration, and power parameters from the oral input speech data by referring to the phoneme sequence; and modifying the concatenated series of digital sound units in accordance with the target prosody to generate synthesized sound data corresponding to the input text data and the target prosody, wherein said processor modifies a power sequence in the concatenated series of digital sound units so as to substantially match the target prosody, wherein said processor smoothes a power sequence in the target prosody, and wherein, in modifying the power sequence in the concatenated series of digital sound units, said processor smoothes the power sequence in the concatenated series of digital sound units, acquires a sequence of ratios between the smoothed power sequence in the concatenated series of digital sound units and the smoothed power sequence in the target prosody, and corrects the smoothed power sequence in the concatenated series of digital sound units in accordance with said sequence of ratios.

7. The sound synthesis device according to claim 6, wherein said processor smoothes the power sequence in the target prosody by acquiring a weighted average of respective powers in the power sequence in the target prosody.

8. The sound synthesis device according to claim 6, wherein, in modifying the power sequence in the concatenated series of digital sound units, said processor adjusts respective time scales of the power sequence in the target prosody and of the power sequence in the concatenated series of digital sound units.

9. A method of synthesizing sound performed by a processor in a sound synthesis device, the method comprising:

receiving text data and extracting phoneme sequence from the text data;

obtaining a plurality of digital sound units from a speech corpus database based on the text data and concatenating the plurality of digital sound units so as to construct a concatenated series of digital sound units that corresponds to the text data;

receiving oral input speech data and calculating, as a target prosody, at least one of pitch height, duration, and power parameters from the oral input speech data by referring to the phoneme sequence; and modifying the concatenated series of digital sound units in accordance with the target prosody to generate synthesized sound data corresponding to the input text data and the target prosody, wherein said processor smoothes a pitch sequence in the target prosody, and wherein, in smoothing said pitch sequence in the target prosody, said processor quantizes pitches of the pitch sequence, and smoothes the pitch sequence by acquiring a weighted moving average of the quantized pitches.

10. A non-transitory storage medium that stores instructions executable by a processor included in a sound synthesis device, said instructions causing the processor to perform the following:

receiving text data and extracting phoneme sequence from the text data;

obtaining a plurality of digital sound units from a speech corpus database based on the text data and concatenating the plurality of digital sound units so as to construct a concatenated series of digital sound units that corresponds to the text data;

receiving oral input speech data and calculating, as a target prosody, at least one of pitch height, duration, and power parameters from the oral input speech data by referring to the phoneme sequence; and modifying the concatenated series of digital sound units in accordance with the target prosody to generate synthesized sound data corresponding to the input text data and the target prosody, wherein said processor smoothes a pitch sequence in the target prosody, and wherein, in smoothing said pitch sequence in the target prosody, said processor quantizes pitches of the pitch sequence, and smoothes the pitch sequence by acquiring a weighted moving average of the quantized pitches.

* * * * *